US006062679A

United States Patent [19]

Meyer et al.

[11] Patent Number: 6,062,679

[45] Date of Patent: May 16, 2000

[54] PRINTHEAD FOR AN INKJET CARTRIDGE AND METHOD FOR PRODUCING THE SAME

[75] Inventors: Neal W. Meyer, Corvallis; Donald L. Michael, Monmouth; Lee Van Nice, Corvallis; Gerald E. Heppell, Tigard, all of Oreg.; Kit Baughman, Escondido, Calif.

[73] Assignee: Hewlett-Packard Company, Palo Alto, Calif.

[21] Appl. No.: 08/922,272

[22] Filed: Aug. 28, 1997

[51] Int. Cl.[7] ..... B41J 2/05

[52] U.S. Cl. ..... 347/63

[58] Field of Search ..... 347/45, 47, 63, 347/64

[56] References Cited

U.S. PATENT DOCUMENTS

| | | | |
|---|---|---|---|
| 3,958,255 | 5/1976 | Chiou et al. | 346/140 |
| 4,329,698 | 5/1982 | Smith | 346/140 |
| 4,368,476 | 1/1983 | Uehara et al. | 346/140 |
| 4,500,895 | 2/1985 | Buck et al. | 346/140 |
| 4,643,948 | 2/1987 | Diaz et al. | 428/422 |
| 4,661,409 | 4/1987 | Kieser et al. | 428/408 |
| 4,663,640 | 5/1987 | Ikeda | 346/140 |
| 4,698,256 | 10/1987 | Giglia et al. | 428/216 |
| 4,740,263 | 4/1988 | Imai et al. | 156/613 |
| 4,749,291 | 6/1988 | Kobayashi et al. | 400/124 |
| 4,771,295 | 9/1988 | Baker et al. | 346/1.1 |
| 4,847,639 | 7/1989 | Sugata et al. | 346/140 |
| 4,890,126 | 12/1989 | Hotomi | 346/140 |
| 4,944,850 | 7/1990 | Dion | 204/15 |
| 5,073,785 | 12/1991 | Jansen et al. | 346/1.1 |
| 5,189,787 | 3/1993 | Reed et al. | 29/831 |
| 5,278,584 | 1/1994 | Keefe et al. | 346/140 |
| 5,305,015 | 4/1994 | Schantz et al. | 346/1.1 |
| 5,426,458 | 6/1995 | Wenzel et al. | 347/45 |
| 5,443,687 | 8/1995 | Koyama et al. | 216/27 |
| 5,508,230 | 4/1996 | Anderson et al. | 437/183 |
| 5,516,500 | 5/1996 | Liu et al. | 423/446 |
| 5,563,640 | 10/1996 | Suzuki | 347/45 |
| 5,581,291 | 12/1996 | Nishiguchi et al. | 347/129 |

FOREIGN PATENT DOCUMENTS

| | | |
|---|---|---|
| 2-223451 | 9/1990 | Japan . |
| WO95/20253 | 7/1995 | WIPO . |

OTHER PUBLICATIONS

*Hewlett–Packard Journal*, vol. 39, No. 4 (Aug. 1988).

Elliott, D.J., *Integrated Circuit Fabrication Technology*, McGraw–Hill Book Company, New York, 1982, pp. 1–41.

Document entitled: "Brilliant Discovery," by QQC, Inc., May 13, 1996.

*Primary Examiner*—John Barlow
*Assistant Examiner*—Michael Brooke

[57] ABSTRACT

A high-durability printhead for an ink cartridge printing system includes a substrate having ink ejectors (e.g. resistors) thereon and an orifice plate positioned above the substrate. The orifice plate (which preferably involves a non-metallic polymer film) has a top surface, bottom surface and a plurality of openings therethrough. To improve the durability of the orifice plate, a protective coating is applied to the top surface and/or the bottom surface of the plate. Representative coatings involve dielectric compositions (including diamond-like carbon) or at least one layer of metal. This approach improves the abrasion and deformation resistance of the plate and avoids "dimpling" problems. Likewise, an intermediate barrier layer of diamond-like carbon is used between the orifice plate and the substrate. As result, an additional level of structural integrity is imparted to the orifice plate and printhead.

12 Claims, 6 Drawing Sheets

PRINTHEAD FOR AN INKJET CARTRIDGE AND METHOD FOR PRODUCING THE SAME

BACKGROUND OF THE INVENTION

The present invention generally relates to printing technology, and more particularly involves an improved, high-durability printhead structure for use in an ink cartridge (e.g. a thermal inkjet system). The present invention is related to U.S. patent application Ser. No. 08/921,675 "Improved Printhead Structure and Method for Producing the Same", filed on behalf of Lee Van Nice et al. on the same date hereof and assigned to the same assignee.

Substantial developments have been made in the field of electronic printing technology. Specifically, a wide variety of highly efficient printing systems currently exist which are capable of dispensing ink in a rapid and accurate manner. Thermal inkjet systems are especially important in this regard. Printing systems using thermal inkjet technology basically involve a cartridge, which includes at least one ink reservoir chamber in fluid communication with a substrate having a plurality of resistors thereon. Selective activation of the resistors causes thermal excitation of the ink and expulsion of the ink from the cartridge. Representative thermal inkjet systems are discussed in U.S. Pat. No. 4,500,895 to Buck et al.; U.S. Pat. No. 4,771,295 to Baker et al.; U.S. Pat. No. 5,278,584 to Keefe et al.; and the *Hewlett-Packard Journal*, Vol. 39, No. 4 (August 1988).

In order to effectively deliver ink materials to a selected substrate, thermal inkjet printheads typically include an outer plate member known as an "orifice plate" or "nozzle plate" which includes a plurality of ink ejection orifices (e.g. openings) therethrough. Initially, these orifice plates were manufactured from one or more metallic compositions including but not limited to gold-plated nickel and similar materials. However, recent developments in thermal inkjet printhead design have resulted in the production of orifice plates which are non-metallic in character, with the term "non-metallic" being defined to involve one or more material layers which are devoid of elemental metals, metal amalgams, or metal alloys. These non-metallic orifice plates are generally produced from a variety of different organic polymers including but not limited to film products consisting of polytetrafluoroethylene (e.g. Teflon®), polyimide, polymethylmethacrylate, polycarbonate, polyester, polyamide polyethylene-terephthalate, and mixtures thereof. A representative polymeric (e.g. polyimide-based) composition which is suitable for this purpose is a commercial product sold under the trademark "KAPTON" by E.I. DuPont de Nemours and Company of Wilmington, Del. (USA). Orifice plate structures produced from the non-metallic compositions described above are typically uniform in thickness, with an average thickness range of about 25–50 $\mu$m. Likewise, they provide numerous benefits ranging from reduced production costs to a substantial simplification of the printhead structure which translates into improved reliability, performance, economy, and ease of manufacture. The fabrication of film-type, non-metallic orifice plates and the corresponding production of the entire printhead structure is typically accomplished using conventional tape automated bonding ("TAB") technology as generally discussed in U.S. Pat. No. 4,944,850 to Dion. Likewise, further detailed information regarding polymeric, non-metallic orifice plates of the type described above are discussed in the following U.S. Pat. No. 5,278,584 to Keefe et al. and U.S. Pat. No. 5,305,015 to Schantz et al.

However, a primary consideration in the selection of any material to be used in the production of an inkjet orifice plate (especially the polymeric compositions listed above) is the overall durability of the completed plate structure. The term "durability" as used herein shall encompass a wide variety of characteristics including but not limited to abrasion and deformation resistance. Both abrasion and deformation of the orifice plate can occur during contact between the orifice plate and a variety of structures encountered during the printing process including wiper-type structures (normally made of rubber and the like) which are typically incorporated within conventional printing systems.

Deformation and abrasion of the orifice plate not only decreases the overall life of the printhead and cartridge associated therewith, but can also cause a deterioration in print quality over time. Specifically, deformation of the orifice plate can result in the production of printed images, which are distorted and indistinct with a corresponding loss of resolution. The term "durability" also encompasses a situation in which the orifice plate is sufficiently rigid to avoid problems associated with "dimpling". Dimpling traditionally involves a situation in which orifice plates made of non-metallic, polymer-containing materials undergo deformation and become essentially non-planar. This condition is typically caused by physical abrasion of the orifice plate, and is likewise associated with the non-planar assembly of the printhead or the non-planar mounting of the printhead to the cartridge unit. Dimpling presents substantial problems including misdirection of the ink droplets being expelled from the printhead which results in improperly printed images. Accordingly, all of these factors are important in producing a completed thermal inkjet system, which has a long life-span and is capable of producing clear and distinct images throughout the life-span of the system.

Prior to development of the present invention, a need existed for an inkjet orifice plate manufactured from non-metallic organic polymer compositions (as well as metallic compounds) having improved durability characteristics. Likewise, a need remained for a printhead having a high level of structural integrity. The present invention satisfies these goals in a unique manner by providing a specialized printhead structure which is characterized by improved durability levels, with these components being applicable to both thermal inkjet and other types of inkjet printing systems. Accordingly, the claimed invention represents a substantial advance in inkjet printing technology as discussed in detail below.

SUMMARY OF THE INVENTION

A printhead for use in an ink cartridge includes a substrate having a first surface with at least one ink ejector thereat. An orifice plate member is positioned over the first substrate surface and includes a first orifice plate surface, a second orifice plate surface, and a plurality of openings passing entirely through the orifice plate member from the first orifice plate surface to the second orifice plate surface. An intermediate barrier layer comprised of diamond-like carbon is disposed between the first orifice plate surface and the first substrate surface.

DETAILED DESCRIPTION OF PREFERRED EMBODIMENTS

Figure 1:
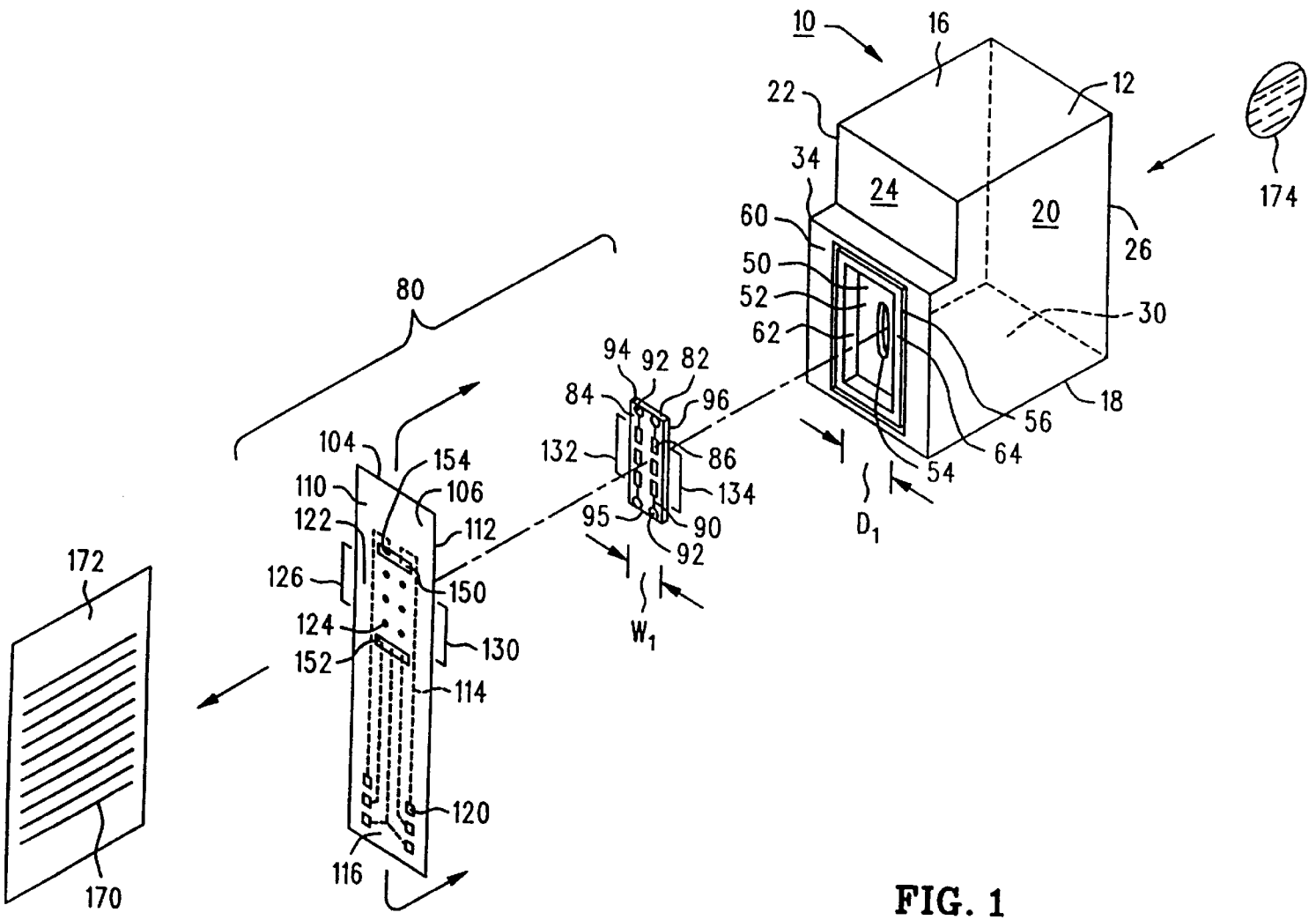
FIG. 1 is an illustration of a representative thermal inkjet cartridge unit, which may be used in connection with the printhead and orifice plate of the present invention.

The present invention involves a unique printhead for an inkjet printing system which includes a specialized structure through which the ink passes. The ink is then delivered to a selected print media material (e.g. paper) using conventional inkjet printing techniques. Thermal inkjet printing systems are particularly suitable for this purpose. In accordance with a preferred embodiment of the invention, the printhead system employs an orifice plate with multiple openings therethrough which is produced from a non-metallic, organic polymer film with specific examples being provided below. To improve the durability of this structure (and the entire printhead), one or more protective coating layers may be applied to the top surface (and/or the bottom surface) of the orifice plate to prevent abrasion, deformation, and/or dimpling of the structure. Alternatively, a high-durability intermediate barrier layer of a special material is provided between the orifice plate and the substrate having the ink ejectors (e.g. heating resistors) thereon. These features cooperate to create a durable, long-life printhead in which a high level of print quality is maintained. Accordingly, as discussed below, the claimed invention and manufacturing processes represent a significant advance in inkjet printing technology.

A. A Brief Overview of Thermal Inkjet Technology and a Representative Cartridge Unit The present invention is applicable to a wide variety of ink cartridge printheads which include (1) an upper plate member having one or more openings therethrough; and (2) a substrate beneath the plate member comprising at least one or more ink "ejectors" thereon or associated therewith. The term "ink ejector" shall be defined to encompass any type of component or system which selectively ejects or expels ink materials from the printhead through the plate member. Thermal inkjet printing systems, which use multiple heating resistors as ink ejectors, are preferred for this purpose. However, the present invention shall not be restricted to any particular type of ink ejector or inkjet printing system as noted above. Instead, a number of different inkjet devices may be encompassed within the invention including but not limited to piezoelectric drop systems of the general type disclosed in U.S. Pat. No. 4,329,698 to Smith, dot matrix systems of the variety disclosed in U.S. Pat. No. 4,749,291 to Kobayashi et al., as well as other comparable and functionally equivalent systems designed to deliver ink using one or more ink ejectors. The specific ink-expulsion devices associated with these alternative systems (e.g. the piezoelectric elements in the system of U.S. Pat. No. 4,329,698) shall be encompassed within the term "ink ejectors" as discussed above. Accordingly, even though the present invention will be discussed herein with primary reference to thermal inkjet technology, it shall be understood that other systems are equally applicable and relevant to the claimed technology.

To facilitate a complete understanding of the present invention as it applies to thermal inkjet technology (which is the preferred system of primary interest), an overview of thermal inkjet technology will now be provided. It is important to emphasize that the claimed invention shall be not restricted to any particular type of thermal inkjet cartridge unit. Many different cartridge systems may be used in connection with the materials and processes of the invention. In this regard, the invention shall be prospectively applicable to any type of thermal inkjet system which uses a plurality of thin-film heating resistors mounted on a substrate as "ink ejectors" to selectively deliver ink materials, with the ink materials passing through an orifice plate having multiple openings therein. The ink delivery systems schematically shown in the drawing figures listed above are provided for example purposes only and are non-limiting.

With reference to FIG. 1, a representative thermal inkjet ink cartridge 10 is illustrated. This cartridge is of a general type illustrated and described in U.S. Pat. No. 5,278,584 to Keefe et al. and the *Hewlett-Packard Journal*, Vol. 39, No. 4 (August 1988). Cartridge 10 is shown in schematic format, with more detailed information regarding cartridge 10 being provided in U.S. Pat. No. 5,278,584. As illustrated in FIG. 1, the cartridge 10 first includes a housing 12 which is preferably manufactured from plastic, metal, or a combination of both. The housing 12 further comprises a top wall 16, a bottom wall 18, a first side wall 20, and a second side wall 22. In the embodiment of FIG. 1, the top wall 16 and the bottom wall 18 are substantially parallel to each other. Likewise, the first side wall 20 and the second sidewall 22 are also substantially parallel to each other.

The housing 12 further includes a front wall 24 and a rear wall 26. Surrounded by the front wall 24, top wall 16, bottom wall 18, first side wall 20, second side wall 22, and rear wall 26 is an interior chamber or compartment 30 within the housing 12 (shown in phantom lines in FIG. 1) which is designed to retain a supply of ink therein as described below. The front wall 24 further includes an externally positioned, outwardly-extending printhead support structure 34, which comprises a substantially rectangular central cavity 50 therein. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment 30 through the ink outlet port 54.

Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate sidewalls, 62, 64 which will likewise be described in greater detail below.

With continued reference to FIG. 1, fixedly secured to housing 12 of the ink cartridge unit 10 (e.g. attached to the outwardly-extending printhead support structure 34) is a printhead generally designated in FIG. 1 at reference number 80. For the purposes of this invention and in accordance with conventional terminology, the printhead 80 actually comprises two main components fixedly secured together (with certain sub-components positioned therebetween). These components and additional information concerning the printhead 80 are provided in U.S. Pat. No. 5,278,584 to Keefe et al. which again discusses the ink cartridge 10 in considerable detail. The first main component used to produce the printhead 80 consists of a substrate 82 referred to herein as a second substrate preferably manufactured from a semiconductor material such as silicon. Secured to the upper surface 84 of the substrate 82 using conventional thin film fabrication techniques is a plurality of individually energizable thin-film resistors 86 which function as "ink ejectors" and are preferably made from a tantalum-aluminum composition known in the art for resistor fabrication. Only a small number of resistors 86 are shown in the schematic representation of FIG. 1, with the resistors 86 being presented in enlarged format for the sake of clarity. Also provided on the upper surface 84 of the substrate 82 using conventional photolithographic techniques is a plurality of metallic conductive traces 90 which electrically communicate with the resistors 86. The conductive traces 90 also communicate with multiple metallic pad-like contact regions 92 positioned at the ends 94, 95 of the substrate 82 on the upper surface 84. The function of all these components which, in combination, are collectively designated herein as a resistor assembly 96 will be discussed further below. Many different materials and design configurations may be used to construct the resistor assembly 96, with the present invention not being restricted to any particular elements, materials, and components for this purpose. However, in a preferred, representative, and non-limiting embodiment discussed in U.S. Pat. No. 5,278,584 to Keefe et al., the resistor assembly 96 is approximately 1.5 cm (0.5 inches) long, and likewise contains 300 resistors 86 thus enabling a resolution of 600 dots per inch ("DPI"). The substrate 82 containing the resistors 86 thereon will preferably have a width "$W_1$" (FIG. 1) which is less than the distance "$D_1$" between the side walls 62, 64 of the mounting frame 56. As a result, ink flow passageways 100, 102 (schematically shown in FIG. 2) are formed on both sides of the substrate 82 so that ink flowing from the ink outlet port 54 in the central cavity 50 can ultimately come in contact with the resistors 86 as discussed further below. It should also be noted that the substrate 82 may include a number of other components thereon (not shown) depending on the type of ink cartridge unit 10 under consideration. For example, the substrate 82 may likewise include a plurality of logic transistors for precisely controlling operation of the resistors 86, as well as a "demultiplexer" of conventional configuration as discussed in U.S. Pat. No. 5,278,584. The demultiplexer is used to demultiplex incoming multiplexed signals and thereafter distribute these signals to the various thin film resistors 86. The use of a demultiplexer for this purpose enables a reduction in the complexity and quantity ol the circuitry (e.g. contract regions 92 and traces 90) formed on the substrate 82. Other features of the substrate 82 (e.g. the resistor assembly 96) will be presented below.

Securely affixed to the upper surface 84 of the substrate 82 (with a number of intervening material layers therebetween including a barrier layer and an adhesive layer in the conventional design of FIG. 1) is the second main component of the printhead 80. Specifically, an orifice plate 104 is provided as shown in FIG. 1 which is used to distribute the selected ink compositions to a designated print media material (e.g. paper). Prior orifice plate designs involved a rigid plate structure manufactured from an inert metal composition (e.g. gold-plated nickel). However, recent developments in thermal inkjet technology have resulted in the use of non-metallic, organic polymer films to construct the orifice plate 104. As illustrated in FIG. 1, this type of orifice plate 104 consists of a flexible film-type substrate 106 manufactured from a selected non-metallic organic polymer film having a thickness of about 25–50 $\mu$m in a representative embodiment. For the purposes of this invention as discussed below, the term "non-metallic" shall involve a composition which does not contain any elemental metals, metal alloys, or metal amalgams. Likewise, the phrase "organic polymer" shall involve a long-chain carbon-containing structure of repeating chemical subunits. A number of different polymeric compositions may be employed for this purpose, with the present invention not being restricted to any particular construction materials. For example, the polymeric substrate 106 may be manufactured from the following compositions: polytetrafluoroethylene (e.g. Teflon®), polyimide, polymethylmethacrylate, polycarbonate, polyester, polyamide polyethylene-terephthalate, or mixtures thereof. Likewise, a representative commercial organic polymer (e.g. polyimide-based) composition which is suitable for constructing the substrate 106 is a product sold under the trademark "KAPTON" by DuPont of Wilmington, Del. (USA). As shown in the schematic illustration of FIG. 1, the flexible orifice plate 104 is designed to "wrap around" the outwardly extending printhead support structure 34 in the completed ink cartridge 10.

Figure 2:
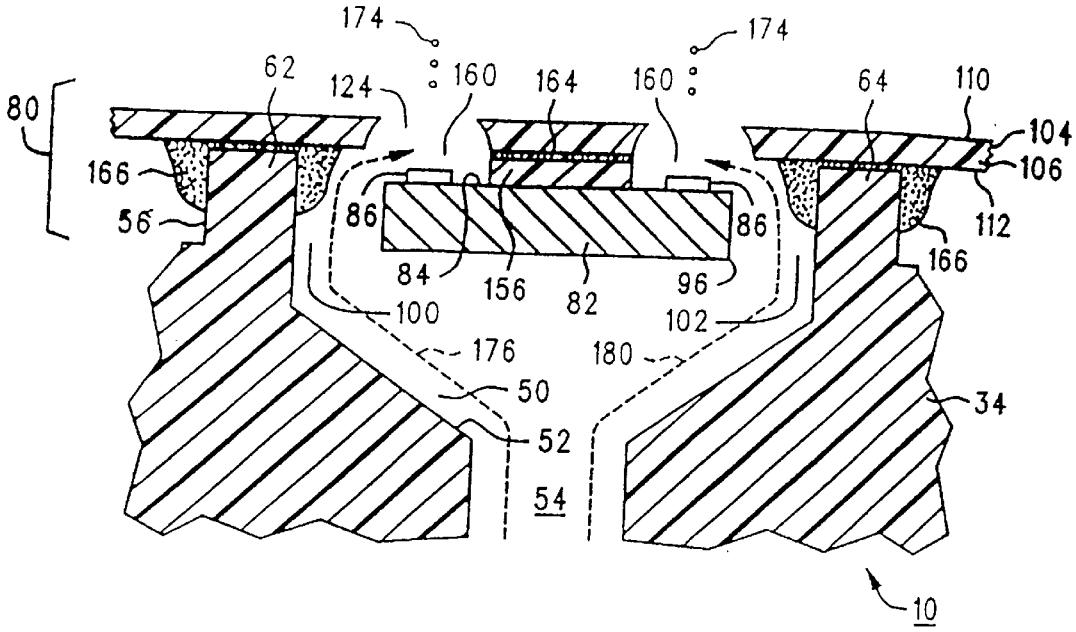
FIG. 2 is an enlarged cross-sectional view of the printhead associated with the thermal inkjet cartridge unit of FIG. 1.

The film-type substrate 106 (e.g. the orifice plate 104) further includes a top surface 110 and a bottom surface 112 (FIGS. 1 and 2). Formed on the bottom surface 112 of the substrate 106 and shown in dashed lines in FIG. 1 is a plurality of metallic (e.g. copper) circuit traces 114 which are applied to the bottom surface 112 using known metal deposition and photolithographic techniques. Many different circuit trace patterns may be employed on the bottom surface 112 of the film-type substrate 106 (orifice plate 104), with the specific pattern depending on the particular type of ink cartridge unit 10 and printing system under consideration. Also provided at position 116 on the top surface 110 of the substrate 106 is a plurality of metallic (e.g. gold-plated copper) contact pads 120. The contact pads 120 communicate with the underlying circuit traces 114 on the bottom surface 112 of the substrate via openings (not shown) through the substrate 106. During use of the ink cartridge 10 in a printer unit, the pads 120 come in contact with corresponding printer contacts in order to transmit electrical control signals from the printer to the contact pads 120 and circuit traces 114 on the orifice plate 104 for ultimate delivery to the resistor assembly 96. Electrical communication between the resistor assembly 96 and the orifice plate 104 will be discussed below.

Disposed within the middle region 122 of the substrate 106 used to produce the orifice plate 104 is a plurality of openings or orifices 124 which pass entirely through the substrate 104. These orifices 124 are shown in enlarged format in FIG. 1. Each orifice 124 in a representative embodiment has a diameter of about 0.01–0.05 mm. In the completed printhead 80, all of the components listed above are assembled (discussed below) so that each of the orifices 124 is aligned with at least one of the resistors 86 (e.g. "ink ejectors") on the substrate 82. As result, energizing a given resistor 86 will cause ink expulsion from the desired orifice 124 through the orifice plate 104. The claimed invention will not be limited to any particular size, shape, or dimensional characteristics in connection with the orifice plate 104 and will likewise not be restricted to any number or arrangement of orifices 124. In a representative embodiment as presented in FIG. 1, the orifices 124 are arranged in two rows 126, 130 on the substrate 106. Likewise, if this arrangement of orifices 124 is employed, the resistors 86 on the resistor assembly 96 (e.g. the substrate 82) will also be arranged in two corresponding rows 132, 134 so that the rows 132, 134 of resistors 86 are in substantial registry with the rows 126, 130 of orifices 124.

Finally, as shown in FIG. 1, dual rectangular windows 150, 152 are provided at each end of the rows 126, 130 of orifices 124. Partially positioned within the windows 150, 152 are beam-type leads 154 which, in a representative embodiment are gold-plated copper and constitute the terminal ends (e.g. the ends opposite the contact pads 120) of the circuit traces 114 positioned on the bottom surface 112 of the substrate 106/orifice plate 104. The leads 154 are designed for electrical connection by soldering, thermocompression bonding, or the like to the contact regions 92 on the upper surface 84 of the substrate 82 associated with the resistor assembly 96. Attachment of the leads 154 to the contact regions 92 on the substrate 82 is facilitated during mass production manufacturing processes by the windows 150, 152 which enable immediate access to these components. As a result, electrical communication is established from the contact pads 120 to the resistor assembly 96 via the circuit traces 114 on the orifice plate 104. Electrical signals from the printer unit (not shown) can then travel via the conductive traces 90 on the substrate 82 to the resistors 86 so that on-demand heating (energization) of the resistors 86 can occur.

At this point, it is important to briefly discuss fabrication techniques in connection with the structures described above which arc used to manufacture the printhead 80. Regarding the orifice plate 104, all of the openings therethrough including the windows 150, 152 and the orifices 124 are typically formed using conventional laser ablation techniques as again discussed in U.S. Pat. No. 5,278,584 to Keefe et al. Specifically, a mask structure initially produced using standard lithographic techniques is employed for this purpose. A laser system of conventional design is then selected, which, in a preferred embodiment, involves an excimer laser of a type, selected from the following alternatives: $F_2$, ArF, KrCl, KrF, or XeCl. Using this particular system (along with preferred pulse energies of greater than about 100 millijoules/$cm^2$ and pulse durations shorter than about 1 microsecond), the above-listed openings (e.g. orifices 124) can be formed with a high degree of accuracy, precision, and control. However, the claimed invention shall not be limited to any particular fabrication method, with other methods also being suitable for producing the completed orifice plate 104 including conventional ultraviolet ablation processes (e.g. using ultraviolet light in the range of about 150–400 nm), as well as standard chemical etching, stamping, reactive ion etching, ion beam milling, and other known processes.

After the orifice plate 104 is produced as discussed above, the printhead 80 is completed by attaching the resistor assembly 96 (e.g. the substrate 82 having the resistors 86 thereon) to the orifice plate 104. In a preferred embodiment, fabrication of the printhead 80 is accomplished using tape automated bonding ("TAB") technology. The use of this particular process to produce the printhead 80 is again discussed in considerable detail in U.S. Pat. No. 5,278,584. Likewise, background information concerning TAB technology is also generally provided in U.S. Pat. No. 4,944,850 to Dion. In a TAB-type fabrication system, the processed substrate 106 (e.g. the completed orifice plate 104) which has already been ablated and patterned with the circuit traces 114 and contact pads 120 actually exists in the form of multiple, interconnected "frames" on an elongate "tape", with each "frame" representing one orifice plate 104. The tape (not shown) is thereafter positioned (after cleaning in a conventional manner to remove impurities and other residual materials) in a TAB bonding apparatus having an optical alignment sub-system. Such an apparatus is well-known in the art and commercially available from many different sources including but not limited to the Shinkawa Corporation of Japan (model no. IL-20). Within the TAB bonding apparatus, the substrate 82 associated with the resistor assembly 96 and the orifice plate 104 are properly oriented so that (1) the orifices 124 are in precise alignment with the resistors 86 on the substrate 82; and (2) the beam-type leads 154 associated with the circuit traces 114 on the orifice plate 104 are in alignment with and positioned against the contact regions 92 on the substrate 82. The TAB bonding apparatus then uses a "gang-bonding" method (or other similar procedures) to press the leads 154 onto the contact regions 92 (which is accomplished through the open windows 150, 152 in the orifice plate 104). The TAB bonding apparatus thereafter applies heat in accordance with conventional bonding processes in order to secure these components together. It is also important to note that other conventional bonding techniques may likewise be used for this purpose including but not limited to ultrasonic bonding, conductive epoxy bonding, solid paste application processes, and other similar methods. In this regard, the claimed invention shall not be restricted to any particular processing techniques associated with the printhead 80.

As previously noted in connection with the conventional cartridge unit 10 in FIG. 1, additional layers of material are typically present between the orifice plate 104 and resistor assembly 96 (e.g. substrate 82 with the resistors 86 thereon). These additional layers perform various functions including electrical insulation, adhesion of the orifice plate 104 to the resistor assembly 96, and the like. With reference to FIG. 2, a representative embodiment of the printhead 80 is illustrated in cross-section after attachment to the housing 12 of the cartridge unit 10, with attachment of these components being discussed in further detail below. As illustrated in FIG. 2, the upper surface 84 of the substrate 82 likewise includes an intermediate barrier layer 156 thereon which covers the conductive traces 90 (FIG. 1), but is positioned between and around the resistors 86 without covering them. As a result, an ink vaporization chamber 160 (FIG. 2) is formed directly above each resistor 86. Within each chamber 160, ink materials are heated, vaporized, and subsequently expelled through the orifices 124 in the orifice plate 104 as indicated below.

The barrier layer or first substrate 156 (which is traditionally produced from conventional organic polymers, photoresist materials, or similar compositions as outlined in U.S. Pat. No. 5,278,584 to Keefe et al.) is applied to the substrate 82 using standard photolithographic techniques or other methods known in the art for this purpose. In addition to clearly defining the vaporization chambers 160, the barrier layer 156 also functions as a chemical and electrical insulating layer. Positioned on top of the barrier layer as shown in FIG. 2 is an adhesive layer 164 which may involve a number of different compositions including uncured polyisoprene photoresist which is applied using conventional photolithographic and other known methods. It is important to note that the use of a separate adhesive layer 164 may, in fact, not be necessary when the top of the barrier layer 156 is made adhesive in some manner (e.g. if it consists of a material which, when heated, becomes pliable with adhesive characteristics). However, in accordance with the conventional structures and materials shown in FIGS. 1–2, a separate adhesive layer 164 is employed.

During the TAB bonding process discussed above, the printhead 80 (which includes the previously-described components) is ultimately subjected to heat and pressure within a heating/pressure-exerting station in the TAB bonding apparatus. This step (which may likewise be accomplished using other heating methods including external heating of the printhead 80) causes thermal adhesion of the internal components together (e.g. using the adhesive layer 164 shown in the embodiment of FIG. 2). As a result, the printhead assembly process is completed at this stage.

The only remaining step involves cutting and separating the individual "frames" on the TAB strip (with each "frame" comprising an individual, completed printhead 80), followed by attachment of the printhead 80 to the housing 12 of the ink cartridge unit 10. Attachment of the printhead 80 to the housing 12 may be accomplished in many different ways. However, in a representative embodiment illustrated schematically in FIG. 2, a portion of adhesive material 166 may be applied to either the mounting frame 56 on the housing 12 and/or selected locations on the bottom surface 112 of the orifice plate 104. The orifice plate 104 is then adhesively affixed to the housing 12 (e.g. on the mounting frame 56 associated with the outwardly-extending printhead support structure 34 shown in FIG. 1). Representative adhesive materials suitable for this purpose include commercially available epoxy resin and cyanoacrylate adhesives known in the art. During the affixation process, the substrate 82 associated with the resistor assembly 96 is precisely positioned within the central cavity 50 as illustrated in FIG. 2 so that the substrate 82 is located within the center of the mounting frame 56 (discussed above and illustrated in FIG. 2). In this manner, the ink flow passageways 100, 102 (FIG. 2) are formed which enable ink materials to flow from the ink outlet port 54 within the central cavity 50 into the vaporization chambers 160 for expulsion from the cartridge unit 10 through the orifices 124 in the orifice plate 104.

To generate a printed image 170 on a selected image-receiving medium 172 (e.g. paper) using the cartridge unit 10, a supply of a selected ink composition 174 (schematically illustrated in FIG. 1) which resides within the interior compartment 30 of the housing 12 passes into and through the ink outlet port 54 within the bottom wall 52 of the central cavity 50. The ink composition 174 thereafter flows into and through the ink flow passageways 100, 102 in the direction of arrows 176, 180 toward the substrate 82 having the resistors 86 thereon (e.g. the resistor assembly 96). The ink composition 174 then enters the vaporization chambers 160 directly above the resistors 86. Within the chambers 160, the ink composition 174 comes in contact with the resistors 86. To activate (e.g. energize) the resistors 86, the printer system (not shown) which contains the cartridge unit 10 causes electrical signals to travel from the printer unit to the contact pads 120 on the top surface 110 of the substrate 106 of the orifice plate 104. The electrical signals then pass through vias (not shown) within the plate 104 and subsequently travel along the circuit traces 114 on the bottom surface 112 of the plate 104 to the resistor assembly 96 containing the resistors 86. In this manner, the resistors 86 can be selectively energized (e.g. heated) in order to cause ink vaporization and resultant expulsion of ink from the printhead 80 by way of the orifices 124 through the orifice plate 104. The ink composition 174 can thus be delivered in a highly selective, on-demand basis to the selected image-receiving medium 172 to generate an image 170 thereon (FIG. 1).

It is important to emphasize that the printing process discussed above is applicable to a wide variety of different thermal inkjet cartridge designs. In this regard, the inventive concepts discussed below shall not be restricted to any particular printing system. However, a representative, non-limiting example of a thermal inkjet cartridge of the type described above which may be used in connection with the claimed invention involves an inkjet cartridge sold by the Hewlett-Packard Company of Palo Alto, Calif. (USA) under the designation "51645A." Likewise, further details concerning thermal inkjet processes in general are outlined in the *Hewlett-Packard Journal*, Vol. 39, No. 4 (August 1988), U.S. Pat. No. 4,500,895 to Buck et al., and U.S. Patent No. 4,771,295 to Baker et al.

B. The Printhead Structures and Methods of the Present Invention

As previously noted, the claimed invention and its various embodiments enable the production of an orifice plate and a thermal inkjet printhead with an improved degree of durability. The term "durability" again involves a variety of characteristics including abrasion and deformation-resistance, as well as enhanced structural integrity. Both abrasion and deformation of the orifice plate can occur during contact between the orifice plate and a variety of structures encountered during the printing process including wiper-type structures made of rubber and the like which are typically incorporated within conventional printer units. Deformation and abrasion of the orifice plate not only decreases the overall life of the printhead and ink cartridge, but likewise causes a deterioration in print quality over time. Specifically, deformation of the orifice plate can result in the generation of printed images, which are distorted and indistinct with a loss of resolution. The term "durability" also includes a situation in which the orifice plate is sufficiently rigid to avoid problems associated with "dimpling". Dimpling traditionally involves a situation in which orifice plates made of non-metallic, polymeric materials undergo deformation or other deviations from a strictly planar configuration which are caused by physical abrasion. Dimpling is likewise associated with the non-planar assembly of the printhead or the non-planar mounting of the printhead to the cartridge unit. Dimpling presents a substantial number of problems including misdirection of the ink droplets expelled from the printhead that results in improperly printed images. Accordingly, all of these factors are important in producing a completed inkjet printing system that has a long life-span and is capable of producing clear and distinct printed images.

Figure 3:
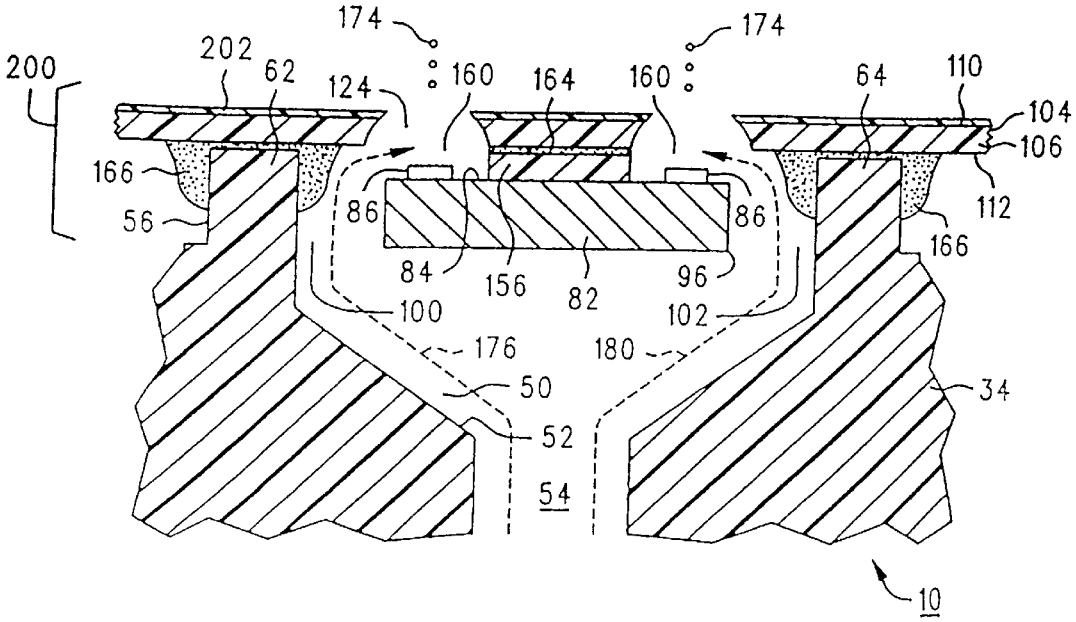
FIG. 3 is an enlarged cross-sectional view of a representative thermal inkjet printhead which includes at least one protective coating layer of a dielectric composition positioned on the top surface of the orifice plate.

With reference to FIG. 3, an enlarged, schematically-illustrated thermal inkjet printhead 200 is illustrated. Reference numbers in FIG. 3 that correspond with those in FIG. 2 signify parts, components, and elements that arc common to the printheads shown in both figures. Such common elements are discussed above in connection with the printhead 80 of FIG. 2, with the discussion of these elements being incorporated by reference with respect to the printhead 200 illustrated in FIG. 3. At this point, it is again important to emphasize that, in a preferred embodiment, the substrate 106 used to produce the orifice plate 104 in the embodiment of FIG. 3 is non-metallic (e.g. non-metal-containing) and consists of a selected organic polymer film as previously described.

As shown in FIG. 3, an additional material layer is provided on the top surface 110 of the substrate 106 used to produce the orifice plate 104 which provides considerable functional benefits (e.g. strength, durability, rigidity, dimple-avoidance, uniform wettability, and the like). With reference to FIG. 3, a protective layer of coating material 202 is deposited directly on at least a portion (e.g. all or part) of the top surface 110 of the substrate 106 associated with the orifice plate 104. In the printhead 200 of FIG. 3, the coating material 202 will consist of at least one dielectric composition, with the term "dielectric" being defined to involve a material that is electrically-insulating and substantially non-conductive. Representative dielectric materials suitable for this purpose include but are not limited to silicon nitride ($Si_3N_4$), silicon dioxide ($SiO_2$), boron nitride (BN), silicon carbide (SiC), and a composition known as "silicon carbon oxide" which is commercially available under the name Dylyn® from Advanced Refractory Technologies, Inc. of Buffalo, N.Y. The layer of coating material 202 is provided on the substrate 106 at or near the middle region 122 (FIG. 1) of the orifice plate 104 which is again defined to involve the region immediately adjacent to and surrounding the orifices 124 through the orifice plate 104. However, it is also contemplated that the entire top surface 110 (or any other selected portion) of the substrate 106/orifice plate 104 could be covered with the protective layer of coating material 202, following by etching of the coating material 202 where needed (e.g. using conventional reactive ion etching, chemical etching, or other known etching techniques). Regardless of where the layer of dielectric coating material 202 is deposited, it is preferred that it have a uniform thickness of about 1000–3000 angstroms, although the exact thickness level to be employed in any given situation will vary, depending on the particular components used in the printhead 200 and other external factors as determined by preliminary pilot testing.

At this point, it is important to emphasize that, in a preferred embodiment, the substrate 106 used to produce the orifice plate 104 in the system of FIG. 3 is non-metallic (e.g. non-metal-containing) and consists of a selected organic polymeric film-type composition as discussed above. The use of this particular material to manufacture an orifice plate represents a departure from conventional technology that involved the use of metallic (e.g. gold-plated nickel) structures. It is an important inventive development in this case to apply a selected dielectric composition directly onto a non-metallic organic polymer orifice plate 104. The combination of these materials produces an orifice plate 104 which is light, readily manufactured using mass-production techniques, and resistant to abrasion, deformation and dimpling (as defined above). Accordingly, application of the selected dielectric materials to a non-metallic orifice plate 104 of the type described herein represents an advance in thermal inkjet technology.

Many different production methods and processing equipment may be employed to deliver the protective layer of coating material 202 onto the top surface 110 of the substrate 106 associated with the orifice plate 104. In this regard, the present invention shall not be limited to any particular process steps or techniques. For example, the following methods can be used to deliver (e.g. directly deposit) the selected dielectric coating material 202 onto the substrate 106: (1) plasma vapor deposition ("PVD"); (2) chemical vapor deposition ("CVD"); (3) sputtering; and (4) laser delivery systems. Techniques (1)–(3) are well known in the art and described in a book by Elliott, D. J., entitled *Integrated Circuit Fabrication Technology*, McGraw-Hill Book Company, New York, 1982 (ISBN No. 0-07-019238-3), pp. 1– 23. Basically, PVD processes involve a technique in which gaseous materials are altered to convert them into vaporized chemical compositions using an rf-based system. These reactive gaseous species are then employed to vapor-deposit the materials under consideration. Further information concerning plasma vapor deposition processes is presented in U.S. Pat. No. 4,661,409 to Kieser et al. CVD methods are similar to PVD techniques and involve a situation in which coatings of selected materials can be formed on a substrate in a system that thermally decomposes various gases to yield a desired product. For example, gaseous materials that may be employed to produce a coating of silicon nitride (Si3N4) on a substrate include $SiH_4$ and $NH_3$. Likewise $SiH_4$ and CO may be used to yield a coating layer of silicon dioxide ($SiO_2$) on a substrate. Further information concerning CVD processes is presented in U.S. Pat. No. 4,740,263 to Imai et al. Sputtering techniques involve ionized gas materials, which are produced using a high energy electromagnetic field, and thereafter delivered to a supply of the material to be deposited. As a result, this material is dispersed onto a selected substrate. Finally, an important laser deposition system applicable to the present invention is extensively discussed in published PCT Application No. WO 95/20253. This method involves the use of a tri-laser system to evaporate and apply a desired composition to a selected substrate in a site-specific manner. Other conventional processes in addition to those listed above which may be employed to deposit the selected layer of dielectric coating material 202 include (A) ion beam deposition methods; (B) thermal evaporation techniques; and the like.

Application of the selected dielectric composition as the protective layer of coating material 202 may be undertaken at any time during the printhead production process which, as noted above, makes extensive use of tape automated bonding (e.g. "TAB") methods generally disclosed in U.S. Pat. No. 4,944,850 to Dion. Thus, the claimed invention and fabrication process shall not be limited to any particular sequence and order of steps. However, in a representative embodiment, the selected coating material 202 is applied to the orifice plate 104 by one of the above-listed techniques during the fabrication process associated with the orifice plate 104. In particular, coating will preferably occur prior to attachment of the substrate 106 to the resistor assembly 96 and before laser ablation of the substrate 106 to form the orifices 124 through the orifice plate 104. After the layer of dielectric coating material 202 is applied, conventional laser ablation processes can then be performed to create the orifices 124 in the orifice plate 104 as discussed above. I However, in certain cases as determined by preliminary testing, the layer of coating material 202 can be applied after the orifices 124 have been formed in the substrate 106.

Figure 4:
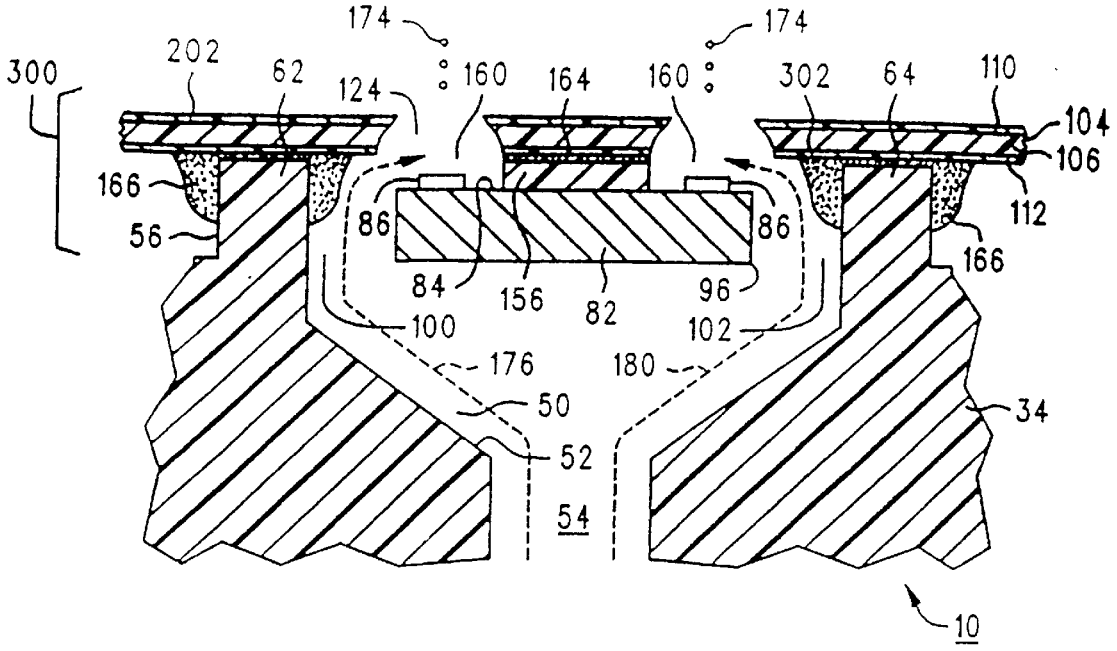
FIG. 4 is an enlarged cross-sectional view of a representative thermal inkjet printhead which includes at least one protective coating layer of a dielectric composition positioned on both the top and bottom surfaces of the orifice plate.

A further modification of the printhead 200 is illustrated in FIG. 4 with reference to printhead 300. In the printhead 300 of FIG. 4, a protective layer of coating material 302 is applied to the bottom surface 112 of the substrate 106 used to produce the orifice plate 104, along with the layer of coating material 202 deposited on the top surface 110 of the substrate 106. This additional layer of coating material 302 will optimally involve the same dielectric materials listed above in connection with the primary layer of coating material 202. Likewise, all of the other information provided above in connection with the coating material 202 (including deposition and manufacturing methods, as well as a preferred thickness level of about 1000–3000 angstroms) is equally applicable to the additional layer of coating material 302. The only difference between the embodiments of FIG. 3 and FIG. 4 is the presence of the layer of coating material 302 which is optimally applied to the bottom surface 112 of the substrate 106 at the same time that the layer of coating material 202 is deposited onto the top surface 110 of the substrate 106. As a result, an orifice plate 104 is produced in which both the top and bottom surfaces 110, 112 are coated with a strength-imparting, dimple-resisting dielectric material that further enhances the structural integrity of the entire printhead 300.

It should also be noted that the printhead 300 shown in FIG. 4 may be further modified to eliminate the layer of coating material 202 from the top surface 110 of the orifice plate 104. As a result, only the layer of coating material 302 on the bottom surface 112 of the substrate 106/orifice plate 104 is present as shown FIG. 5. This "modified" printhead is designated at reference number 400 in FIG. 5. While it is preferred that the layer of coating material 202 on the top surface 110 of the substrate 106 be present to achieve maximum protection of the orifice plate 104, the modified orifice plate 104 discussed above and shown in FIG. 5 which only includes the layer of coating material 302 on the bottom surface 112 may be useful in connection with lower-stress situations where only one layer of strength-imparting material on the orifice plate 104 is necessary.

Figure 5:
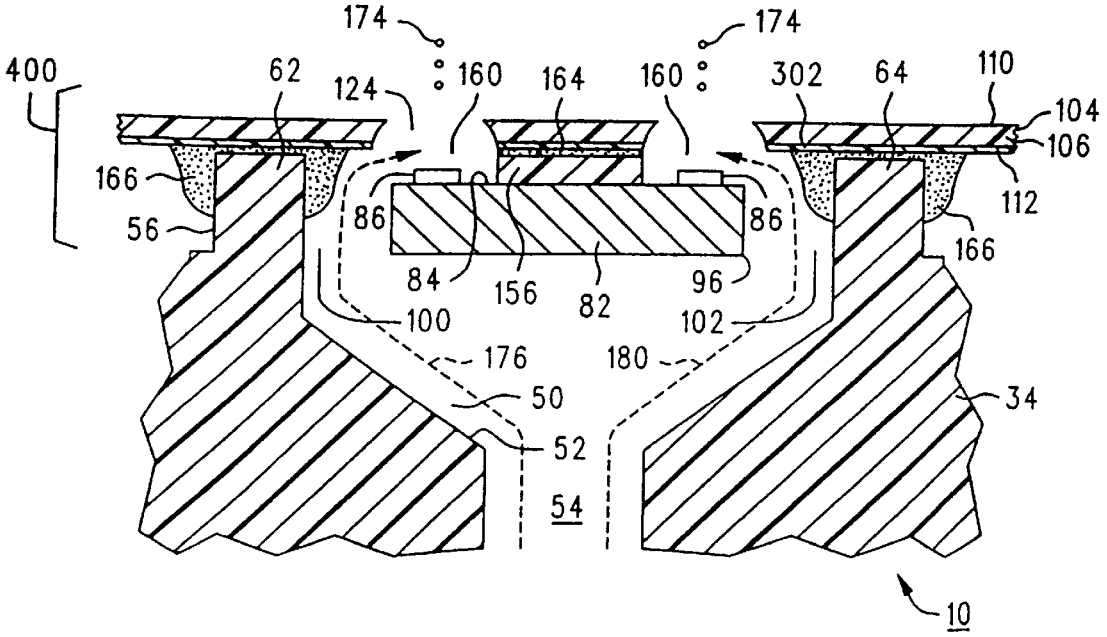
FIG. 5 is an enlarged cross-sectional view of a representative thermal inkjet printhead which includes at least one protective coating layer of a dielectric composition positioned on only the bottom surface of the orifice plate.

In a still further variation, a specific dielectric material which may be employed as the protective layer of coating material 202 and/or coating material 302 on the orifice plate 104 in the embodiments of FIGS. 3–5 is a composition known as "diamond-like carbon" or "DLC". This material is particularly well-suited for this purpose in view of its strength, flexibility, resilience, high modulus for stiffness, favorable adhesion characteristics, and inert character. DLC is discussed specifically in U.S. Pat. No. 4,698,256 to Giglia, and particularly involves a very hard and durable carbon-based material with diamond-like characteristics. On an atomic level, DLC (which is also characterized as "amorphous carbon") consists of carbon atoms molecularly attached using $sp^3$ bonding although $sp^2$ bonds may also be present. As a result, DLC exhibits many traits of conventional diamond materials (e.g. hardness, inertness, and the like) while also having certain characteristics associated with graphite (which is dominated by $sp^2$ bonding). It also adheres in a strong and secure manner to the overlying and underlying materials (e.g. polymeric barrier layers and the like) which are typically present in thermal inkjet printheads. When applied to a substrate, DLC is very smooth with considerable hardness and abrasion resistance. In this regard, it is an ideal material for use as the protective layer of coating material 202 (and/or layer of coating material 302) on the orifice plate 104 in the printheads 200, 300, 400 (FIGS. 3–5). Additional information concerning DLC, as well as manufacturing techniques for applying this material to a selected substrate are discussed in U.S. Pat. No. 4,698,256 to Giglia et al.; U.S. Pat. No. 5,073,785 to Jansen et al.; U.S. Pat. No. 4,661,409 to Kieser et al.; and U.S. Pat. No. 4,740,263 to Imai et al. However, all of the information provided above regarding application of the other dielectric materials to the orifice plate 104 (including thickness levels) is equally applicable to the delivery of DLC to the orifice plate 104. Specifically, the following delivery methods may again be used for DLC deposition onto the top surface 110 and/or bottom surface 112 of the orifice plate 104 as discussed and defined above: (1) plasma vapor deposition ("PVD"); (2) chemical vapor deposition ("CVD"); (3) sputtering; (4) laser deposition systems as discussed in PCT Application WO 95/20253; (5) ion beam deposition methods; and (6) thermal evaporation techniques. Processing steps involving the deposition of DLC (and the order in which they are undertaken) are the same as those discussed above in connection with the other dielectric materials delivered to the orifice plate 104 in the embodiments of FIGS. 3–5. The foregoing information is therefore incorporated by reference in this section of the present disclosure. However, it is important to emphasize that the use of DLC as a protective coating on the outer surface of a non-metallic, organic polymer-containing orifice plate is an important development which results in a unique composite structure (e.g. one or more diamond-like carbon layers plus a polymeric organic layer). This specific structure and its use in the claimed printheads 200, 300, 400 again provides many benefits ranging from exceptional abrasion-resistance and a high modulus of stiffness to the control of dimpling and improved adhesion characteristics.

The completed printheads 200, 300, 400 shown in FIGS. 3–5 which include the combined benefits of a non-metallic polymer-containing orifice plate 104 and an abrasion resistant, highly durable dielectric coating material 202, 302 thereon may then be used to produce a thermal inkjet cartridge unit of improved design and effectiveness. This is accomplished by securing the completed printhead 200 (or printheads 300, 400) to the housing 12 of the inkjet cartridge 10 shown in FIG. 1 in the same manner discussed above in connection with attachment of the printhead 80 to the housing 12. As a result, the printhead 200 (or printheads 300, 400) will be in fluid communication with the internal chamber 30 inside the housing 12 which contains the selected ink composition 174. Accordingly, the discussion provided above regarding attachment of the printhead 80 to the housing 12 is equally applicable to attachment of the printhead 200 (or printheads 300, 400) in position to produce a completed thermal inkjet cartridge 10 with improved durability characteristics. It is again important to emphasize that the claimed printheads 200, 300, 400 and the benefits associated therewith are applicable to a wide variety of different thermal inkjet cartridge systems, with the present invention not being restricted to any particular cartridge designs or configurations. A representative cartridge system which may be employed in combination with the printhead 200 (or printheads 300, 400) is again disclosed in U.S. Pat. No. 5,278,584 to Keefe et al. and is commercially available from the Hewlett-Packard Company of Palo Alto, Calif. (USA)—model no. 51645A. Furthermore, while the embodiments of FIGS. 3–5 primarily involve an orifice plate 104 constructed from a non-metallic organic polymer composition, it is also contemplated that a metallic orifice plate (e.g. made of gold-plated nickel) of the type discussed in U.S. Pat. No. 4,500,895 to Buck et al. can likewise be treated with a selected dielectric composition (including DLC). All of the information provided above regarding the application of these compositions to the organic polymer-type orifice plate 104 is therefore equally applicable to metallic orifice plate systems (including thickness levels, deposition methods, and the like). It is also important to note that the previously-discussed dielectric materials may be applied to all or part of the selected orifice plate structure (whether metallic, non-metallic, or a combination of both) at any location on the top or bottom surfaces thereof for the above-described purposes. The term "orifice plate" as used herein shall also be defined to encompass "composite" type systems in which a metallic plate member is positioned within an opening through an organic polymer-containing film having conductive traces and pads thereon as discussed in U.S. Pat. No. 5,189,787 to Reed et al. In this particular situation, the phrase "orifice plate" will be defined to involve the entire composite structure including both of the components listed above so that deposition of the selected dielectric material (including DLC) onto either the metallic plate or any part of the attached polymeric film will technically involve the application of such materials to the "orifice plate" as claimed so that the above-listed benefits and others (e.g. ink short protection) can be achieved. Likewise, when it is stated that the orifice plate of the present invention is comprised of a non-metallic polymeric composition, such an orifice plate will be defined to encompass (1) a one piece orifice plate made entirely of a selected non-metallic polymeric material as discussed above; and (2) an orifice plate in which at least part (but not necessarily all) of the structure is made of a non-metallic organic polymer which would include the "composite" type system listed above. Finally, the terms "positioned on" and "applied" when used to describe the application of various coating materials to the orifice plate shall preferably involve a situation in which the selected coating materials are "directly deposited" onto the plate so that there are no intervening materials therebetween. These considerations apply to both the devices listed herein and the methods discussed below in all of the claimed embodiments except where otherwise noted.

Likewise, the basic method associated with the embodiments of FIGS. 3–5 represents an important development in thermal printing technology. This basic method involves: (1) providing an inkjet printhead which includes a substrate having multiple ink ejectors (e.g. resistors) thereon and an orifice plate positioned over the substrate with a top surface, a bottom surface, and a plurality of orifices therethrough; and (2) depositing a protective, strength-imparting layer of coating material directly onto any portion of the top and/or bottom surfaces of the orifice plate. The protective coating in the embodiments of FIG. 3–5 (which are related by the use of common coating materials) again involves a selected dielectric composition, with DLC providing excellent results. This method for protecting an orifice plate on a printhead may be accomplished in accordance with the techniques discussed above or through the use of routine modifications to the listed processes.

Figure 6:
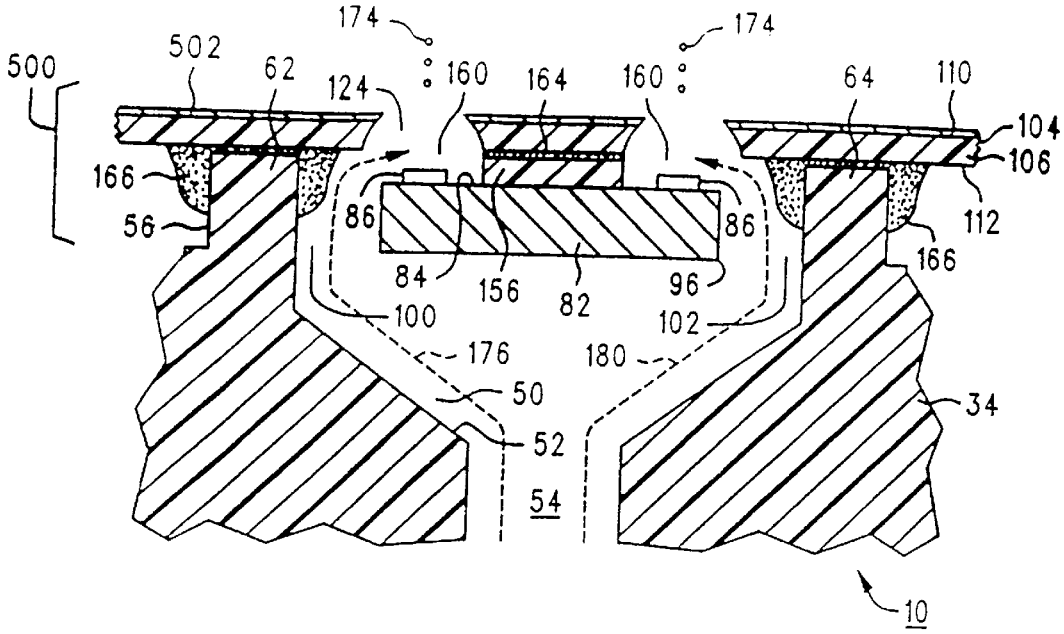
FIG. 6 is an enlarged cross-sectional view of a representative thermal inkjet printhead, which includes at least one protective coating layer of a selected metal composition positioned on the top surface of the orifice plate.

An alternative printhead design is illustrated schematically and in enlarged format in FIG. 6 at reference number 500. This embodiment likewise provides the same benefits listed above, namely, improved durability (e.g. abrasion and deformation-resistance). However, as discussed in detail below, it involves the deposit of at least one layer of a selected metal composition directly onto the top surface 110 of the substrate 106 used to produce the orifice plate 104. The embodiment shown in FIG. 6 need not be restricted to any particular metal materials for this purpose, with a wide variety of metals being suitable for use including chromium (Cr), nickel (Ni), palladium (Pd), gold (Au), titanium (Ti), tantalum (Ta), aluminum (Al), and mixtures (e.g. compounds) thereof. In this embodiment, the term "metal composition" shall be defined to encompass an elemental metal, a metal alloy, or a metal amalgam. Likewise, the phrase "at least one" in connection with the metal-containing layer shown in FIG. 6 (discussed further below) shall signify a situation in which one or multiple layers of a selected metal composition can be employed, with the final structure associated with the printhead 500 being determined by preliminary pilot testing. Accordingly, this embodiment shall not be restricted to any particular number or arrangement of metal-containing layers on the orifice plate 104, wherein one or more layers will function effectively. The implementation shown in FIG. 6, in its broadest sense, will therefore involve the novel concept of applying at least one layer of a selected metal composition to an orifice plate in an ink ejector-containing printhead wherein the orifice plate is preferably comprised of a non-metallic, organic polymer. As a result, a unique "metal+polymer" orifice plate system is provided in the printhead 500.

With specific reference to the FIG. 6, a cross-sectional, schematic, and enlarged view of the printhead 500 is provided. Reference numbers in FIG. 6 that correspond with those in FIG. 2 signify parts, components, and elements that are common to the printheads shown in both figures. Such common elements are described above in connection with the printhead 80 of FIG. 2, with the discussion of these elements being incorporated by reference with respect to the printhead 500 illustrated in FIG. 6. At this point, it is again important to emphasize that the substrate 106 used to produce the orifice plate 104 in the embodiment of FIG. 6 is preferably non-metallic (e.g. non-metal-containing) and consists of a selected organic polymer film as previously described.

In accordance with the discussion provided above, at least part (e.g. some or all) of the upper surface 110 of the substrate 106 used to produce the orifice plate 104 in the printhead 500 is covered with at least one protective layer of coating material being comprised of one or more metal compositions. In FIG. 6, the metallic layer of coating material is designated at reference number 502. The metallic composition associated with the layer of coating material 502 shall not be restricted to any particular metal materials for this purpose, with a wide variety of metals being suitable for use including chromium (Cr), nickel (Ni), palladium (Pd), gold (Au), titanium (Ti), tantalum (Ta), aluminum (Al), and mixtures (e.g. compounds) thereof as previously noted. Deposition of the metallic coating material 502 is accomplished using conventional techniques that are known in the art for this purpose including all of those listed above in the embodiments of FIGS. 3–5. These methods include (1) plasma vapor deposition ("PVD"); (2) chemical vapor deposition ("CVD"); (3) sputtering; (4) laser deposition processes (e.g. as discussed in PCT Application WO 95/20253); (5) ion beam deposition methods; and (6) thermal evaporation techniques. Definitions, information, and supporting background references regarding these techniques are discussed above and incorporated by reference in this section of the present disclosure. The selection of any given deposition method will be determined by preliminary pilot studies in accordance with the specific materials selected for use in the printhead 500. Likewise, to achieve optimum results, the metallic layer of coating material 502 will have a thickness of about 200–5000 angstroms, with the exact thickness level for a given situation again being determined by preliminary analysis.

The representative example of FIG. 6 incorporates a single layer of coating material 502. However, the term "at least one" as it applies to the metallic coating layer(s) delivered to the top surface 110 of the orifice plate 104 shall again be defined to involve one or more individual layers of material.

Figure 7:
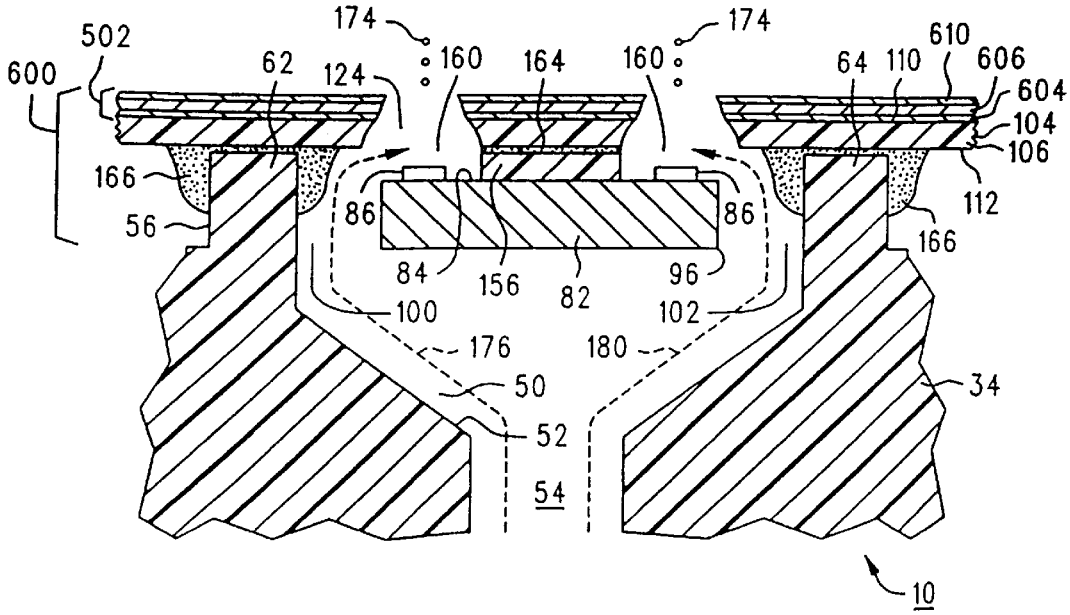
FIG. 7 is an enlarged cross-sectional view of a representative thermal inkjet printhead produced in accordance with the embodiment of FIG. 6 in which a specific group of multiple metal-containing layers is used in connection with the protective metallic coating layer positioned on the top surface of the orifice plate.

FIG. 7 involves a modification of printhead 500 shown at reference number 600 in which the basic layer of coating material 502 actually consists of three separate metal-containing sub-layers which each function as individual layers of coating material. As illustrated in the specific example of FIG. 7 (which is designed to produce ideal strength and adhesion characteristics), the protective layer of metallic coating material 502 initially consists of a first layer (e.g. sub-layer) of metal 604 deposited directly on the top surface 110 of the substrate 106/orifice plate 104. The first layer of metal 604 is designed to function as a "seed" layer which effectively bonds the other metal sub-layers 606, 610 to the orifice plate 104 as shown in FIG. 7. Metal compositions selected for this purpose should be capable of strong adhesion to the organic polymers used in connection with the orifice plate 104. Representative metals suitable for use in the first layer of metal 604 in the three-layer embodiment of FIG. 7 involve a first metal composition selected from the group consisting of chromium (Cr), nichrome, tantalum nitride, tantalum-aluminum, and mixtures thereof. Again, the first layer of metal 604 is deposited directly on the top surface 110 of the substrate 106/orifice plate 104 using one or more of the deposition techniques listed above in connection with the basic layer of coating material 502. Prior to deposition of the first layer of metal 604, ideal results will be achieved if the top surface 10 of the substrate 106 is pre-treated to remove adsorbed species and contaminants therefrom. Pre-treatment may be accomplished using known techniques including but not limited to conventional ion bombardment processes. In a preferred embodiment, the first layer of "seed" metal 604 will have a uniform thickness of about 25–600 angstroms.

Next, a second layer (e.g. sub-layer) of metal 606 is deposited directly on top of the first layer of metal 604 using one or more of the previously-described deposition techniques. The second layer of metal 606 is designed to impart strength, rigidity, anti-dimpling characteristics, and deformation-resistance to the orifice plate 104. Representative metals suitable for this purpose involve a second metal composition selected from the group consisting of titanium (Ti), nickel (Ni), copper (Cu) and mixtures thereof, with the second layer of metal 606 having a preferred thickness of about 1000–3000 angstroms.

Deposited directly on top of the second layer of metal 606 is a third and final layer (e.g. sub-layer) of metal 610 shown in FIG. 7. Application of the third layer of metal 610 is again accomplished using one or more of the above-described deposition techniques. The third layer of metal 610 is designed to impart both corrosion resistance and reduced friction to the completed orifice plate 104 (especially with respect to the first and second layers of metal 604, 606 which are positioned beneath the third layer of metal 610). To achieve optimum results, the third layer of metal 610 will be about 100–300 angstroms thick.

The resulting protective layer of metallic coating material 502 shown in FIGS. 6–7 (which, in the non-limiting embodiment of FIG. 7, involves a composite of multiple (e.g. three) metal layers 604, 606, 610) provides the benefits listed above, namely, improved abrasion resistance, dimpling control, and uniform wettability. However, as previously noted, any number of metal-containing layers (e.g. one or more) may be deposited on the top surface 110 of the substrate 106 associated with the orifice plate 104. For example, titanium (Ti) has excellent "seed" and strength-imparting characteristics. A single increased-thickness layer of titanium may therefore be used instead of the dual layers 604, 606 listed above, followed by application of the final layer 610 onto the titanium layer. Regardless of whether a single metal layer or multiple metal layers are used as the protective layer of coating material 502 in the embodiment of FIGS. 6–7, it is preferred that the layer of coating material 502 have a total (combined) thickness level of about 200–5000 angstroms. Again, this value may be varied in accordance with preliminary tests involving the specific printhead components of interest.

Application of the protective layer of metallic coating material 502 to the substrate 106 associated with the orifice plate 104 may be undertaken at any time during the printhead production process which, as noted above, makes extensive use of tape automated bonding (e.g. "TAB") methods disclosed in U.S. Pat. No. 4,944,850 to Dion. Thus, the claimed invention and fabrication process shall not be restricted to any particular processing steps and order in which these steps are taken. However, to achieve optimum results, the metal composition(s) used to produce the protective layer of coating material 502 (whether one or more layers are involved) will be applied to the polymeric substrate 106/orifice plate 104 prior to attachment of the substrate 106 to the resistor assembly 96. Regarding laser ablation of the substrate 106 to form the orifices 124 therethrough, preliminary testing will be employed to determine whether ablation should occur before or after metal layer deposition. In the embodiment shown in FIG. 7 and discussed above, laser ablation will optimally occur after deposition of the first or "seed" layer of metal 604 and before delivery of the second and third layers of metal 606, 610 onto the first layer of metal 604. In other variations of the printhead 500 (and printhead 600 involving different numbers of metal "sub-layers" associated with the main layer of coating material 502), laser ablation will take place after metal delivery in situations where the deposited metal to be ablated has a thickness of less than about 400 angstroms. In situations where the deposited metal layer(s) have a combined thickness of 400 angstroms or more, ablation will typically occur before metal deposition. However, it is important to re-emphasize that the claimed invention shall not be restricted to any specific production methods, which shall be determined in accordance with a routine preliminary analysis.

Figure 8:
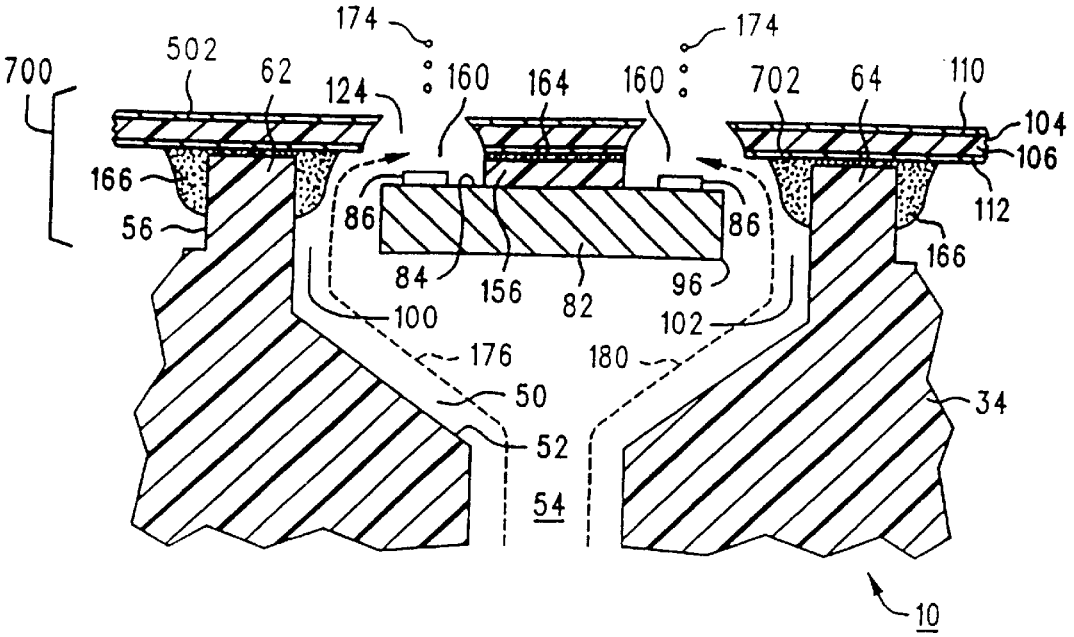
FIG. 8 is an enlarged cross-sectional view of a representative thermal inkjet printhead which includes at least one protective coating layer of a selected metal composition positioned on both the top surface and bottom surface of the orifice plate.

A still further modification to the printhead 500 described above and shown in FIG. 6 is illustrated in FIG. 8 at reference number 700. In printhead 700, a protective layer of metallic coating material 702 is applied to the bottom surface 112 of the substrate 106 used to produce the orifice plate 104. This additional layer of coating material 702 will involve the same metal compositions previously described in connection with the primary layer of coating material 502 (e.g. one or more individual layers of the representative metals listed above). Likewise, all of the other information provided above in connection with the layer of coating material 502 (including thickness values, deposition processes, and manufacturing methods) is equally applicable to the additional layer of coating material 702. The only difference of consequence between the embodiments of FIG. 6 and FIG. 8 is the presence of the additional layer of metallic coating material 702 which is applied to the bottom surface 112 of the orifice plate 104. The additional layer of metallic coating material 702 may be applied to the bottom surface 112 of the orifice plate 104 at the same time that the layer of metallic coating material 502 is deposited onto the top surface 110 of the substrate 106, or may be applied at different times. As a result, an orifice plate 104 is produced in which both the top and bottom surfaces 110, 112 are coated with strength-imparting, dimple-resisting metallic compositions which further enhance the overall structural integrity of the entire printhead 700. Incidentally, it should be noted that the layer of metallic coating material 502 on the top surface 110 of the orifice plate 104 in the embodiment of FIG. 8 may also involve the multi-layer coating configuration illustrated in FIG. 7 wherein three separate metal "sub-layers" 604, 606, 610 are employed for this purpose.

Figure 9:
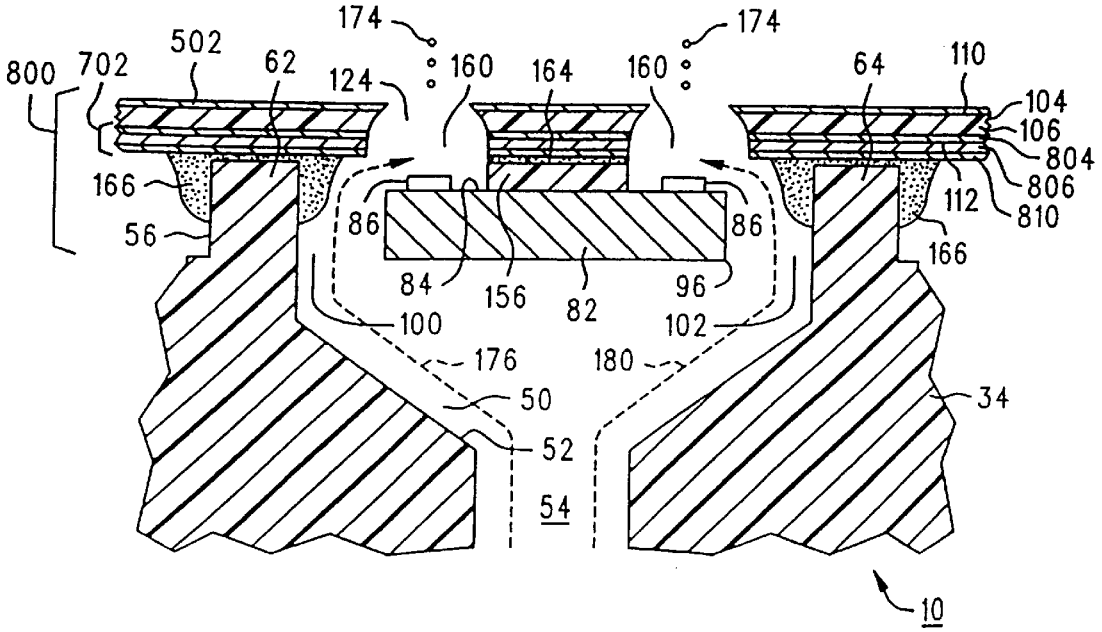
FIG. 9 is an enlarged cross-sectional view of a representative thermal inkjet printhead produced in accordance with the embodiment of FIG. 8 in which a specific group of multiple metal-containing layers is used in connection with the protective metallic coating layer positioned on the bottom surface of the orifice plate.

While the embodiment of FIG. 8 uses a single metal layer in connection with the coating material 702 on the bottom surface 112 of the orifice plate 104, one or more individual layers of a selected metal composition may also be employed for this purpose. With reference to FIG. 9, a modified printhead 800 is provided which involves the use of sequentially-applied multiple metallic layers in connection with the layer of coating material 702. Specifically a primary layer (e.g. sub-layer) of metal 804 is deposited directly on the bottom surface 112 of the substrate 106/orifice plate 104. The primary layer of metal 804 is designed to function as a "seed" layer which effectively bonds the other metal sub-layers 806, 810 (discussed below) to the orifice plate 104 as shown in FIG. 9. Metal compositions selected for this purpose should be capable of strong adhesion to the organic polymers used to form the orifice plate 104. Representative metals suitable for use in the primary layer of "seed" metal 804 preferably involve the same compositions listed above in connection with the first layer of metal 604 in the embodiment of FIG. 7. Specifically, the primary layer of metal 804 will optimally consist of a first metal composition selected from the group consisting of chromium (Cr), nichrome, tantalum nitride, tantalum-aluminum, and mixtures thereof. Again, the primary layer of metal 804 is deposited directly on the bottom surface 112 of the substrate 106 using one or more of the deposition techniques listed above. Prior to deposition of the primary layer of metal 804 onto the substrate 106, ideal results will be achieved if the bottom surface 112 of the substrate 106 is pre-treated to remove adsorbed species and contaminants. Pre-treatment may be accomplished using known techniques including but not limited to conventional ion bombardment processes. In a representative embodiment, the primary layer of metal 804 will have a uniform thickness of about 25–600 angstroms.

Next, a secondary layer (e.g. sub-layer) of metal 806 (FIG. 9) is deposited directly onto the primary layer of metal 804 using one of the previously-described deposition techniques. The secondary layer of metal 806 is designed to impart additional strength, rigidity, anti-dimpling characteristics, and deformation-resistance to the orifice plate 104. Representative metals suitable for this purpose are preferably the same as those listed above in connection with the second layer of metal 606 in the embodiment of FIG. 7. Specifically, the secondary layer of metal 806 in FIG. 9 will optimally consist of a second metal composition selected from the group consisting of nickel (Ni), titanium (Ti), copper (Cu), and mixtures thereof, with the secondary layer of metal 806 having a preferred thickness of about 1000–3000 angstroms.

Figure 10:
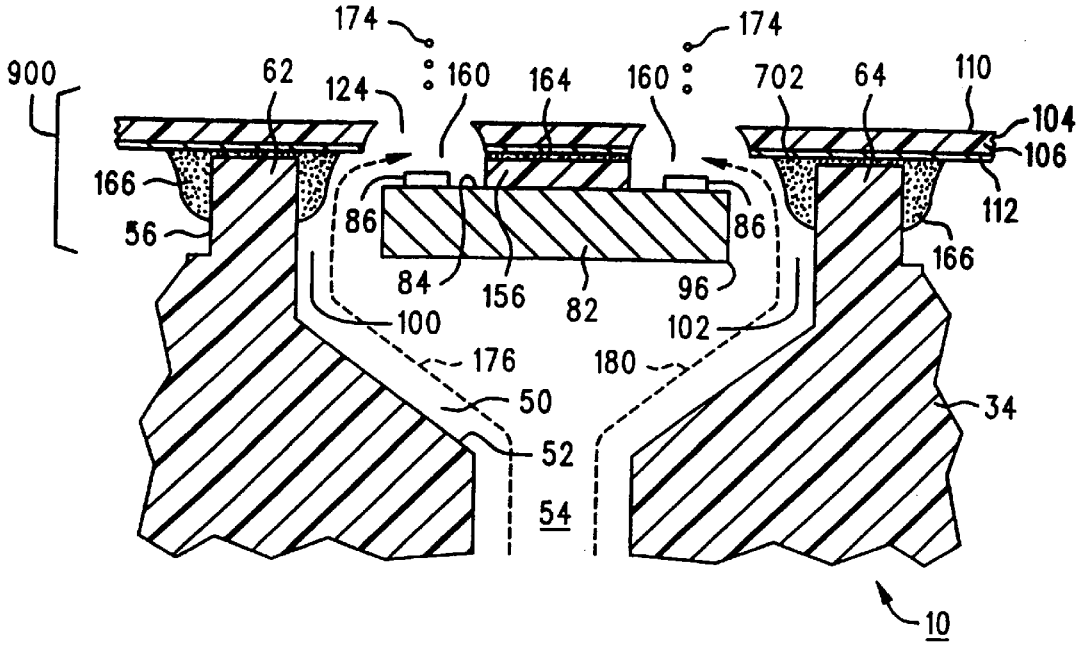
FIG. 10 is an enlarged cross-sectional view of a representative thermal inkjet printhead which includes at least one protective coating layer of a selected metal composition positioned on only the bottom surface of the orifice plate.

Deposited directly onto the secondary layer of metal 806 is a tertiary and final layer (e.g. sub-layer) of metal 810 shown in FIG. 9. Application of the tertiary layer of metal 810 is again accomplished using one or more of the above-described deposition techniques. The tertiary layer of metal 810 is primarily designed to impart corrosion resistance to the completed orifice plate 104 (especially with respect to the first and second layers of metal 804, 806 which are positioned above the tertiary layer of metal 810). To achieve optimum results, the tertiary layer of metal 810 will be about 100–300 angstroms thick. However, any number of metal-containing layers (e.g. one or more) may be deposited on the bottom surface 112 of the substrate 106 associated with the orifice plate 104. For example, titanium (Ti) has excellent "seed" and strength-imparting characteristics. A single increased-thickness layer of titanium may therefore be used instead of the dual layers 804, 806 listed above, followed by application of the final layer 810 onto the titanium layer. In addition, it should also be noted that the metallic coating material 502 on the top surface 110 of the orifice plate 104 in the embodiment of FIG. 9 may also involve the multi-layer coating configuration shown in FIG. 7 in which three separate metal "sub-layers" 604, 606, 610 are employed for this purpose The printheads 700, 800 of FIGS. 8–9 may be further modified to produce an additional printhead 900 illustrated in FIG. 10. In printhead 900, the main layer of metallic coating material 502 on the top surface 110 of the orifice plate 104 is eliminated. As a result, only the additional layer of coating material 702 on the bottom surface 112 of the substrate 106/orifice plate 104 will be present as shown in FIG. 10. While it is preferred that the layer of coating material 502 on the top surface 110 of the substrate 106 be present to achieve maximum protection of the orifice plate 104, the modified orifice plate 104 discussed above and shown in FIG. 10 which only includes the coating material 702 on the bottom surface 112 may be useful in connection with lower-stress situations in which only one layer of strength-imparting material on the orifice plate 104 is necessary.

The completed printheads 500, 600, 700, 800, 900 shown in FIGS. 6–10 which include the combined benefits of a non-metallic polymer-containing orifice plate 104 and an abrasion resistant, metal-containing layer of coating material 502, 702 thereon may then be used to produce a thermal inkjet cartridge unit of improved design and effectiveness. This is accomplished by securing the completed printhead 500 (or printheads 600–900) to the housing 12 of the inkjet cartridge 10 shown in FIG. 1 in the same manner discussed above in connection with attachment of the printhead 80 to the housing 12. As a result, the printhead 500 (or the other printheads 600–900 listed above) will be in fluid communication with the internal chamber 30 inside the housing 12 which contains the selected ink composition 174. Accordingly, the discussion provided above regarding attachment of the printhead 80 to the housing 12 is equally applicable to attachment of the printhead 500 (or printheads 600–900) in position to produce a completed thermal inkjet cartridge 10 with improved durability characteristics. It is again important to emphasize that the claimed printheads 500–900 and the benefits associated therewith are applicable to a wide variety of different thermal inkjet cartridge systems (or other types of inkjet delivery units), with the present invention not being restricted to any particular cartridge designs or configurations. A representative cartridge system which may be employed in combination with the printheads 500–900 is disclosed in U.S. Pat. No. 5,278,584 to Keefe et al. and is commercially available from the Hewlett-Packard Company of Palo Alto, Calif. (USA)—model no. 51645A. It is also important to note that the previously discussed metal compositions may be applied to all or part of the selected orifice plate structure at any location on the top or bottom surfaces thereof for the above-described purposes and additional benefits.

Likewise, the basic method associated with the embodiments of FIGS. 6–10 represents an important development in inkjet printing technology. This basic method involves: (1) providing an inkjet printhead which includes a substrate having multiple ink ejectors (e.g. resistors) thereon and an orifice plate positioned over the substrate with a top surface, a bottom surface, and a plurality of orifices therethrough; and (2) depositing a protective layer of coating material directly on at least one of the top surface and bottom surface of the orifice plate. The protective coating in the embodiments of FIGS. 6–10 (which are related by the use of common coating materials) again involves a selected metal composition. This method for protecting a non-metallic, polymer-containing orifice plate on a printhead may be accomplished in accordance with the techniques discussed above or through the use of routine modifications to the listed processes. Regardless of which steps are actually employed to manufacture the improved printheads 500–900 of FIGS. 6–10, the method in its broadest sense (which, in a representative embodiment, involves applying a protective metallic coating to a non-metallic, organic polymer-containing orifice plate) represents an advance in the art of inkjet technology.

Figure 11:
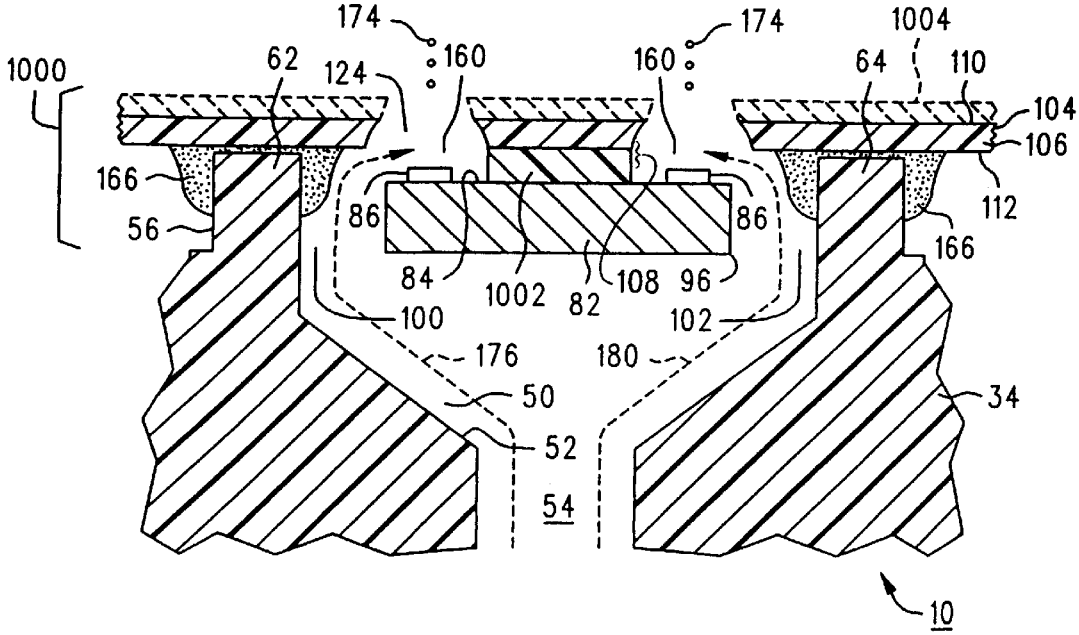
FIG. 11 is an enlarged cross-sectional view of a representative thermal inkjet printhead which includes an intermediate layer of barrier material positioned between the orifice plate and the ink ejector (e.g. resistor)-containing substrate in which the intermediate layer of barrier material consists of diamond-like carbon.

A preferred embodiment is schematically illustrated in enlarged format in FIG. 11. Specifically, this embodiment involves a barrier layer system which utilizes DLC (e.g. "diamond-like carbon") as extensively discussed above. With reference to FIG. 11, a printhead 1000 is illustrated. Reference numbers in FIG. 11, which correspond with those in FIG. 2 signify parts, components, and elements that are common to the printheads shown in both figures. Such common elements are discussed above in connection with the printhead 80 of FIG. 2, with the discussion of these elements being incorporated by reference with respect to the printhead 1000 illustrated in FIG. 11. At this point, it is again important to emphasize that the substrate 106 used to produce the orifice plate 104 in the embodiment of FIG. 11 is preferably non-metallic (e.g. non-metal-containing) and consists of a selected organic polymer film as previously described.

In the printhead 1000 of FIG. 11, the intermediate barrier layer 156 which was previously illustrated in FIG. 2 has been removed and replaced with an intermediate barrier layer 1002 that specifically consists of DLC ("diamond-like carbon"). This material was extensively discussed above in connection with the embodiments of FIGS. 3–5, with the foregoing information being equally applicable to the embodiment of FIG. 11. In particular, the DLC-containing barrier layer 1002 is positioned between the bottom surface 12 of the orifice plate 104 and the upper surface 84 of the substrate 82 used to produce the resistor assembly 96, thus creating an interface 108. Likewise, as shown in FIG. 11, the DLC-containing barrier layer 1002 is appropriately configured to form the ink vaporization chambers 160 illustrated in FIG. 11. In a preferred embodiment, the DLC-containing barrier layer 1002 has a uniform thickness of about 10–40 microns, although the claimed invention shall not be exclusively limited to any particular thickness levels. Regarding application of the DLC-containing barrier layer 1002, it can be directly deposited on (1) the upper surface 84 of the substrate 82 used in connection with the resistor assembly 96 prior to attachment of the assembly 96 to the orifice plate 104; or (2) the bottom surface 112 of the substrate 106 used in connection with the orifice plate 104. Regardless of which approach is used (which will be determined in accordance with the particular manufacturing considerations selected for production of the printhead 1000), the DLC-containing barrier layer 1002 can be applied to either the orifice plate 104 or the resistor assembly 96 (substrate 82) using the known techniques listed and defined above, including (1) plasma vapor deposition ("PVD"); (2) chemical vapor deposition ("CVD"); (3) sputtering; (4) laser deposition processes as discussed in PCT Application WO 95/20253; (5) ion beam deposition methods; and (6) thermal evaporation techniques. Thereafter, regardless of how and where the DLC-containing barrier layer 1002 is applied, it can be configured to define the vaporization chambers 160 by conventional caustic etching/patterning processes as discussed in Elliott, D. J., *Integrated Circuit Fabrication Technology*, McGraw-Hill Book Company, New York, 1982 (ISBN No. 0-07-019238-3), pp. 24–41. Likewise, it should also be emphasized that any attachment/placement methods may be employed in connection with the DLC-containing barrier layer 1002 provided that, in some manner, the barrier layer 1002 is ultimately positioned between the orifice plate 104 and the substrate 82 associated with the resistor assembly 96.

In the embodiment of FIG. 11, adhesive materials (e.g. the adhesive layer 164 shown in FIG. 2) are omitted for the sake of clarity. However, if the DLC-containing barrier layer 1002 is initially deposited on the orifice plate 104 using the techniques discussed above, the resistor assembly 96 (e.g. substrate 82) is then attached to the barrier layer 1002 using a layer of adhesive material positioned between the barrier layer 1002 and the substrate 82. This adhesive material will optimally be of the same type listed above in connection with the adhesive layer 164 in FIG. 2. Likewise, if the DLC-containing barrier layer 1002 is initially deposited on the resistor assembly 96 (e.g. substrate 82) using the foregoing techniques, then the orifice plate 104 is subsequently secured to the barrier layer 1002 using a layer of adhesive material between the barrier layer 1002 and the orifice plate 104. Again, the adhesive material used for this purpose will preferably be of the same type listed above in connection with the adhesive layer 164 (FIG. 2).

The use of a DLC-containing intermediate barrier layer 1002 in the printhead 1000 provides a number of important benefits compared with prior barrier systems. Specifically, it is more readily adhered to and/or deposited on the other materials in the printhead 1000 described above. It also offers an improved level of durability and dimensional stability over time. Finally, it has a very high hardness level, but is flexible enough to bend when needed. All of these benefits produce a durable printhead 1000 with a greater degree of structural integrity compared with non-DLC-containing systems.

It should also be noted that the top surface 110 of the orifice plate 104 may further include an optional protective layer of coating material thereon as shown in phantom lines at reference number 1004 which is particularly beneficial if the orifice plate 104 in the printhead 1000 is constructed from non-metallic, organic polymer materials as discussed above. This protective layer of coating material 1004 may involve one or more layers of a selected dielectric composition (e.g. of the same type as the coating material 202 in the embodiment of FIG. 3). In particular, representative dielectric materials suitable for this purpose include silicon dioxide ($SiO_2$), boron nitride (BN), silicon nitride ($Si_3N_4$), diamond-like carbon ("DLC"), silicon carbide (SiC), and silicon carbon oxide. Likewise, all of the information and teclmiques described above in connection with the protective layer of coating material 202 in the embodiment of FIG. 3 are equally applicable to the layer of coating material 1004 in the embodiment of FIG. 11 if dielectric compositions are involved. The layer of coating material 1004 in FIG. 11 may alternatively involve one or more layers of a selected metal composition (e.g. of the same type as the metallic coating material 502 in the embodiment of FIG. 6). Specifically, the metallic layer(s) associated with the coating material 1004 may be manufactured from the following representative metal compositions: chromium (Cr), nickel (Ni), palladium (Pd), gold (Au), titanium (Ti), tantalum (Ta), aluminum (Al), and mixtures (e.g. compounds) thereof. All of the other information and techniques described above in connection with the protective layer of metallic coating material 502 in the embodiment of FIG. 6 are equally applicable to the layer of coating material 1004 in this embodiment.

The completed printhead 1000 shown in FIG. 11 may then be used to produce a thermal inkjet cartridge unit of improved design and effectiveness. This is accomplished by securing the completed printhead 1000 to the housing 12 of the inkjet cartridge 10 shown in FIG. 1 in the same manner discussed above in connection with attachment of the printhead 80 to the housing 12. As a result, the printhead 1000 will be in fluid communication with the internal chamber 30 inside the housing 12 which contains the selected ink composition 174. Accordingly, the discussion provided above regarding attachment of the printhead 80 to the housing 12 is equally applicable to attachment of the printhead 1000 in position to produce a completed thermal inkjet cartridge 10 with improved durability characteristics. It is again important to emphasize that the claimed printhead 1000 and the benefits associated therewith are applicable to a wide variety of different ink cartridge systems (e.g. both thermal inkjet cartridges and other types), with the present invention not being restricted to any particular cartridge designs or configurations. A representative cartridge system which may be employed in combination with the printhead 1000 is disclosed in U.S. Pat. No. 5,278,584 to Keefe et al. and is commercially available from the Hewlett-Packard Company of Palo Alto, Calif. (USA)—model no. 51645A.

Finally, the basic method associated with the embodiment of FIG. 11 represents another important development in inkjet printing technology. This method involves (1) providing an inkjet printhead which includes a substrate having one or more ink-ejectors (e.g. resistors) thereon and an orifice plate member positioned over and above the substrate; and (2) placing an intermediate barrier layer between the orifice plate and the substrate having the ink-ejectors thereon, with the barrier layer being comprised of diamond-like carbon. This unique method for increasing the strength and durability of the completed printhead may be accomplished as discussed above or in accordance with routine modifications to the listed processes. Regardless of which steps which are employed to manufacture the improved printhead 1000 of FIG. 11, the method in its broadest sense (which involves placing a DLC-containing barrier layer between an orifice plate and an ink-ejector-containing substrate in a printhead) represents a further advance in the art of inkjet printing technology.

All of the embodiments described above provide a common benefit, namely, the production of an inkjet printhead with substantially improved strength, durability, structural integrity, and operating efficiency. Specifically, the printheads and orifice plates of the present invention are: (1) dimensionally stable; (2) dimpling and abrasion-resistant; (3) resistant to deformation; and (4) have desirable (uniform) ink wetting characteristics. These goals are accomplished by the unique printhead designs discussed above which represent a significant advance in the art of inkjet technology.

We claim:

1. A printhead for use in an ink cartridge comprising:

a first substrate having opposed surfaces and a plurality of ink vaporization chambers formed therein, a second substrate having opposed surfaces, said first substrate being disposed on said second substrate;

at least one ink ejector disposed on a first surface of said opposed surfaces of said second substrate;

an orifice plate member positioned over a first surface of said opposed surfaces of said first substrate, said orifice plate member further comprising a first orifice plate surface, a second orifice plate surface, and a plurality of openings passing entirely through said orifice plate member from said first orifice plate surface to said second orifice plate surface, said first substrate being a barrier layer consisting of diamond-like carbon with which said second orifice plate surface of said orifice plate forms an interface.

2. The printhead of claim 1 further comprising a protective layer of coating material positioned on said first orifice plate surface, said protective layer of coating material being comprised of at least one dielectric composition.

3. The printhead of claim 2 wherein said at least one dielectric composition further comprises a dielectric composition selected from the group consisting of silicon nitride, silicon dioxide, boron nitride, silicon carbide, amorphous carbon and silicon carbon oxide.

4. The printhead of claim 1 further comprising a protective layer of coating material positioned on said first orifice plate surface, said protective layer of coating material being comprised of at least one metal composition.

5. The printhead of claim 1 wherein said diamond-like carbon barrier is an adhesive for said orfice plate.

6. An ink cartridge comprising:

a housing comprising an ink-retaining compartment therein; and a printhead affixed to said housing and in fluid communication with said compartment therein, said printhead comprising:

a first substrate having opposed surfaces and a second substrate having opposed surfaces, said first substrate being disposed on said second substrate, at least one ink ejector disposed on a first surface of said opposed surfaces, an orifice plate member positioned over said first surface of said opposed surfaces of said first substrate, said orifice plate member further comprising a first orifice plate surface, a second orifice plate surface, and a plurality of openings passing entirely through said orifice plate member from said first orifice plate surface to said second orifice plate surface; and said first substrate being barrier layer, consisting of diamond-like carbon, with which said second orifice plate surface of said orifice plate forms a diamond-like carbon interface.

7. The ink cartridge of claim 6 further comprising a protective layer of coating material positioned on said first orifice plate surface, said protective layer of coating material being comprised of at least one dielectric composition.

8. The ink cartridge of claim 7 wherein said at least one dielectric composition further comprises a composition selected from the group of silicon nitride, silicon dioxide, boron nitride, silicon carbide, amorphous carbon and silicon carbon oxide.

9. The ink cartridge of claim 6 further comprising a protective layer of coating material positioned on said first orifice plate surface, said protective layer of coating material being comprised of at least one metal composition.

10. The printhead of claim 6 wherein said diamond-like carbon barrier provides structural integrity to said printhead.

11. A method of producing a printhead for use in an ink cartridge comprising the steps of:

forming a first substrate having opposed surfaces and a second substrate having opposed surfaces;

disposing at least one ink ejector on a first surface of said opposed surfaces of said second substrate;

creating a plurality of openings passing entirely through an orifice plate member from a first orifice plate surface to a second orifice plate surface;

disposing said orifice plate member over said first surface of said first substrate;

arranging at least one of said plurality of openings in a predetermined association with said ink ejector; and disposing said first substrate on said second substrate wherein said first substrate is a barrier layer consisting of diamond-like carbon.

12. A method for separating the orifice plate member from a substrate comprising at least one ink ejector thereon in an ink cartridge printhead comprising the steps of:

providing a printhead comprising:

a first substrate having opposed surfaces and a second substrate having opposed surfaces, a first surface of said opposed surfaces of said second substrate comprising at least one ink ejector thereat; and an orifice plate member positioned over said first substrate, said orifice plate member further comprising a first orifice plate surface, a second orifice plate surface, and a plurality of openings passing entirely through said orifice plate member from said first orifice plate surface to said second orifice plate surface; and disposing a first substrate being a barrier layer consisting of diamond-like carbon with said second surface of said orifice plate to form a diamond-like carbon interface.

* * * * *